US005307394A

United States Patent [19]

Sokolov

[11] Patent Number: 5,307,394

[45] Date of Patent: Apr. 26, 1994

[54] DEVICE FOR PRODUCING X-RAY IMAGES ON OBJECTS COMPOSED OF PHOTO OR X-RAY SENSITIVE MATERIALS

[76] Inventor: Oleg Sokolov, 64-39 98 St., #4B, Rego Park, N.Y. 11374

[21] Appl. No.: 9,976

[22] Filed: Jan. 27, 1993

[51] Int. Cl.[5] ..... G21K 5/00

[52] U.S. Cl. ..... 378/34; 378/35; 378/147

[58] Field of Search ..... 378/34, 35, 145, 147, 378/149, 154; 250/492.2

[56] References Cited

U.S. PATENT DOCUMENTS

| | | | |
|---|---|---|---|
| 4,329,410 | 5/1982 | Buckley | 378/35 X |
| 4,827,138 | 5/1989 | Randall | 250/492.2 |
| 4,868,093 | 9/1989 | Levy | 378/35 X |
| 4,951,305 | 8/1990 | Moore et al. | 378/147 |
| 5,135,609 | 8/1992 | Rease et al. | 378/35 X |

*Primary Examiner*—David P. Porta
*Attorney, Agent, or Firm*—I. Zborovsky

[57] ABSTRACT

A device for forming an X-ray image in objects composed of a photo or an X-ray sensitive material has a plurality of layers each having X-ray non-transmitting areas and X-ray transmitting areas, each of the areas of each of the layers having transverse sizes corresponding to respective transverse sizes of openings to be formed or an image of partitions between the openings, the X-ray non-transmitting areas of each layer which form the image of partitions between the openings being located at an angle from zero to 89.99° relative to a central beam of an exposing radiation, the layers having a height such as to provide a ratio of its height not less than 1 with respect to a distance between the layers.

8 Claims, 2 Drawing Sheets

DEVICE FOR PRODUCING X-RAY IMAGES ON OBJECTS COMPOSED OF PHOTO OR X-RAY SENSITIVE MATERIALS

BACKGROUND OF THE INVENTION

The present invention relates to a device for producing X-ray images on objects of photo or X-ray sensitive materials, for example for producing X-ray grids and substrates for boards.

Devices of the above mentioned general type are known in the art. The known devices provide for a possibility of producing X-ray images with certain limited number of elements of different shapes and sizes. However, possibilities of the known devices are rather limited.

SUMMARY OF THE INVENTION

Accordingly, it is an object of the present invention to provide a device for making X-ray images on objects composed of photo or X-ray sensitive materials, which is a further improvement of the existing devices and provides for the possibility of producing an image with a great number of elements of different shapes and different sizes.

In keeping with these objects and with others which will become apparent hereinafter, one feature of the present invention resides, briefly stated, in a device for producing X-ray images on objects composed of photo or X-ray sensitive materials, which has a plurality of layers each having X-ray non-transmitting areas and X-ray transmitting areas, each of the areas of each of the layers having transverse sizes corresponding to respective transverse sizes of openings to be formed or an image of partitions between the openings, the X-ray non-transmitting areas of each layer which form the image of partitions between the openings being located at an angle from zero to 89.99° relative to a central beam of an exposing radiation, the layers having a height such as to provide a ratio of its height not less than 1 with respect to a distance between the partitions of the openings.

When the device is designed in accordance with the present invention X-ray images can be produced with great number of elements with different shapes, and different sizes by superposing of elementary images in the plane of the substrate. The ratio between the height of the partitions to the distance between the partitions is preferably 1 or more.

The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
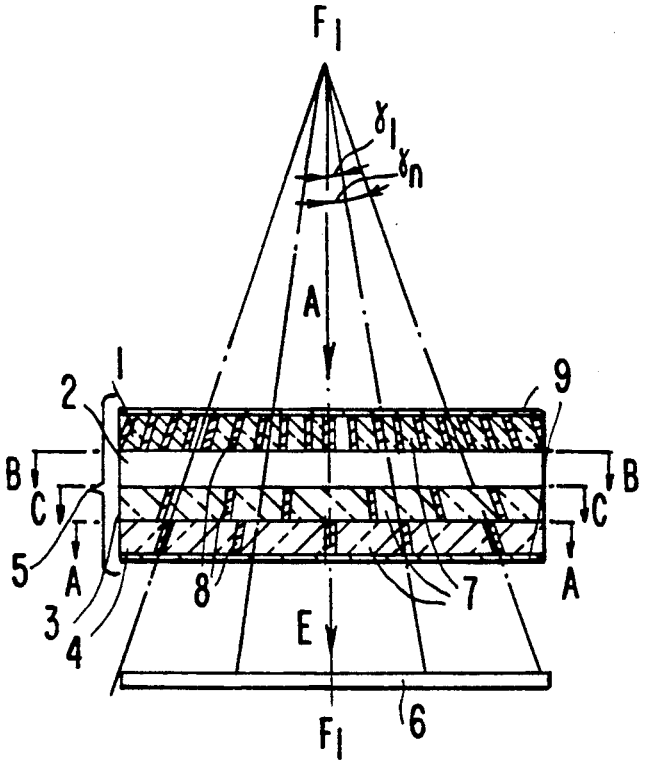
FIG. 1 is a view schematically showing a device for producing X-ray images on objects composed of photo or X-ray sensitive materials.

A device for producing X-ray images on objects composed of photo or X-ray sensitive materials has a plurality of plates which are identified with reference numerals 1, 2, 3 and 4 and form bevels of a set 5. The plates 1, 2, 3, 4 are arranged on one another so that the projections of areas 7 of the plates which are transmitting for the X-ray radiation are superposed over one another on a substrate 6 and form an image of openings while the projections of areas 8 which are non-transmitting for the X-ray radiation form an image of partitions between the openings.

Figure 3:
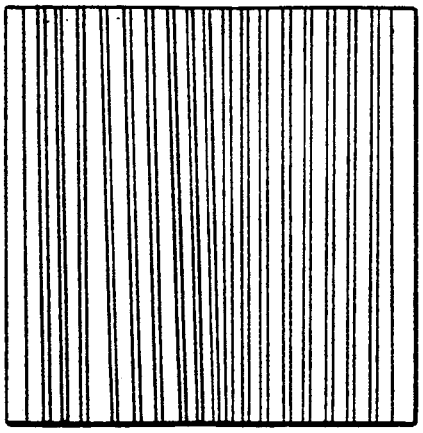
FIG. 3 is a multi-view aa in accordance with the present invention.
Figure 5:
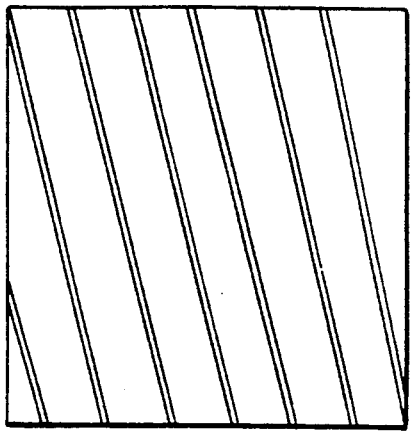
FIGS. 4, 5 and 6 are views showing sections bb, cc, and dd in FIG. 1.
Figure 4:
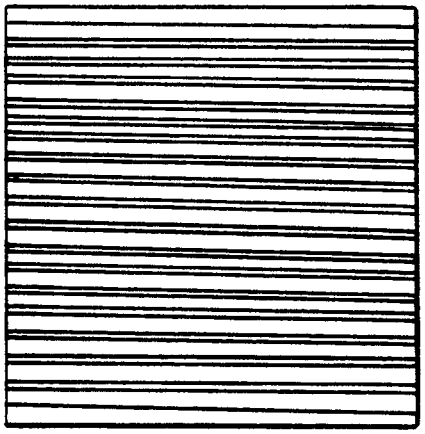
Figure 6:
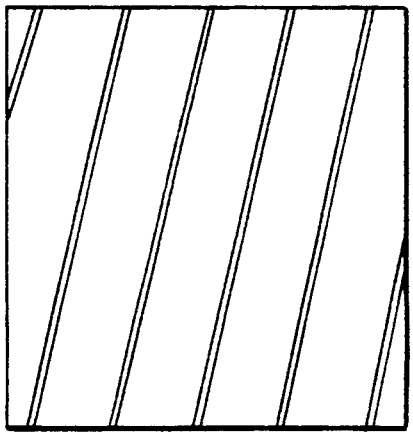

The X-ray non-transmitting areas can be arranged parallel to one another or as shown in FIGS. 3 and 4 or at an angle relative to one another in the plane of the substrate 6 as shown in FIGS. 5 and 6. Also, they can be arranged at an angle relative to a central beam F-F1 of X-ray radiation as shown in FIG. 1. The magnitude of the angles of the X-ray non-transmitting areas relative to the beam F-F1 is determined by a focal distance of the grid. When the X-ray non-transmitting areas extend parallel to the axis F-F1 of symmetry of the grid, the image of parallel openings is formed on the substrate 6.

Figure 2:
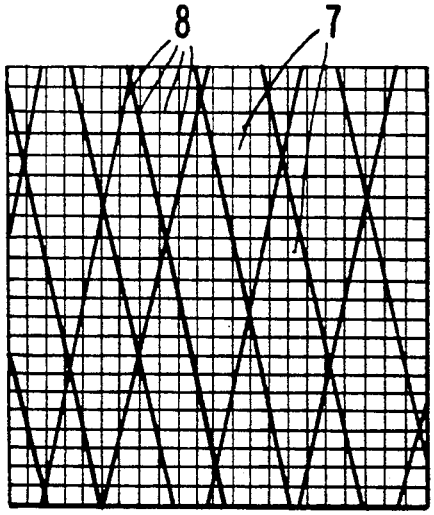
FIG. 2 is a view showing an X-ray image of a pattern on an X-ray sensitive base.

As can be seen from FIGS. 3–6, the X-ray non-transmitting areas and X-ray transmitting areas extend in each layer only in one direction. When the layers are placed on one another, these areas in different layers extend transversely to each other, so that a final image of the openings and the partitions is produced as a result of X-ray radiation passing through all layers, as shown in FIG. 2.

In the embodiment shown in FIG. 1 the plates are non-releasably connected with one another. In this case they are mechanically protected by X-ray transmitting covers 9.

Figure 7A:
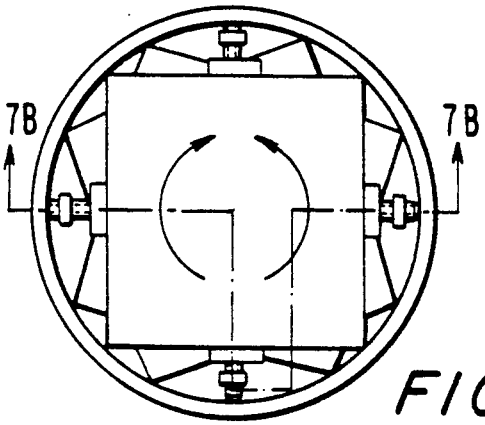
FIGS. 7A and 7B are views showing a further embodiment of the inventive device.
Figure 7B:
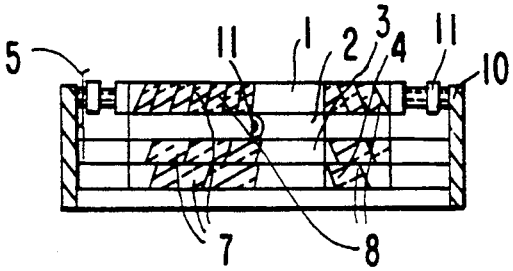

FIGS. 7A and 7B show the device in which the plates are releasably connected with one another. As a result, the layers formed by the plates can freely turn in any direction parallel to their planes around an axis of symmetry which coincides with the central beam F-F1 of the X-ray radiation. The turning is performed inside a frame 10, and the plates are fixed in a selected position by fixing elements 11. The plates can be turned relative to one another in any direction independently of one another. They can be replaced partially or completely. Also, additional plates can be inserted, or some plates can be removed, so as to provide the production of a desired pattern.

The device operates in the following manner:

Beams of exposing radiation extend through the X-ray transmitting area 7 of the plates 1, 2, 3, 4 and fall onto the respective zones of the substrate 6. The falling of the beams of exposing radiation beyond the above mentioned zones is prevented by selection of the ratio between the height of the X-ray non-transmitting areas 8 to the distance between them is 1 or more. Due to the superposition of the pattern of the X-ray transmitting areas of a simple shape over one another, in the plane of image on the substrate it is possible to produce images of actually any complicated shape.

It will be understood that each of the elements described above, or two or more together, may also find a useful application in other types of constructions differing from the types described above.

While the invention has been illustrated and described as embodied in a device for producing X-ray images on objects composed of photo or X-ray sensitive materials, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to the protected by Letters Patent is set forth in the appended claims:

1. A device for forming an X-ray image in objects composed of a photo or an X-ray sensitive material, comprising a plurality of layers each having X-ray non-transmitting areas and X-ray transmitting areas, each of said areas of said layers having transverse sizes corresponding to respective transverse sizes of openings to be formed or an image of partitions between the openings, said X-ray non-transmitting areas of each layer which form the image of the partitions between the openings being located at an angle from zero to 89.99° relative to a central beam of an exposing radiation, said layers having a height such as to provide a ratio of its height not less than 1 with respect to a distance between said non-transmitting areas of each layer, said layers are releasably and exchangeably connected with one another.

2. a device for forming an X-ray image in objects composed of a photo or an X-ray sensitive material, comprising a plurality of layers each having X-ray non-transmitting areas and X-ray transmitting areas, each of said areas of said layers having transverse sizes corresponding to respective transverse sizes of openings to be formed or an image of partitions between the openings, said X-ray non-transmitting areas of each layer which form the image of the partitions between the openings being located at an angle from zero to 89.99° relative to a central beam of an exposing radiation, said layers having a height such as to provide a ratio of its height not less than 1 with respect to a distance between said non-transmitting areas of each layer, said layers are turnable relative to one another; and means for fixing said layers in any of a plurality of turning positions.

3. A device as defined in claim 2, wherein said means include elements for fixing said layers in selected position.

4. A device for forming an X-ray image in objects composed of a photo or an X-ray sensitive material, comprising a plurality of layers each having X-ray non-transmitting areas and X-ray transmitting areas, each of said areas of said layers having transverse sizes corresponding to respective transverse sizes of openings to be formed or an image of partitions between the openings, said X-ray non-transmitting areas of each layer which form the image of the partitions between the openings being located at an angle from zero to 89.99° relative to a central beam of an exposing radiation, said layers having a height such as to provide a ratio of its height not less than 1 with respect to a distance between said non-transmitting areas of each layer, said X-ray non-transmitting areas and said X-ray transmitting areas of each of said layers extending only in one direction, said layers being arranged over one another so that said X-ray non-transmitting areas and said X-ray transmitting areas of said layers extend transversely to each other when said layers are arranged over one another so as to form together a final image of the openings and the partitions.

5. A device as defined in claim 4; and further comprising X-ray transmitting covers surrounding outer surfaces of outer ones of said layers.

6. A device as defined in claim 4, wherein said areas extend parallel to one another in a plane of each layer.

7. A device as defined in claim 4, wherein said areas are inclined relative to one another in a plane of each of said layers.

8. A device as defined in claim 4, wherein said layers are non-releasably connected with one another.

* * * * *